US005501524A

United States Patent [19]

Zuidema

[11] Patent Number: 5,501,524

[45] Date of Patent: Mar. 26, 1996

[54] METHOD FOR MIXING GRANULATES, POWDERS AND LIQUIDS AND A DEVICE THEREFOR

[76] Inventor: Hette Zuidema, Roomweg 268, 7523 BW Enschede, Netherlands

[21] Appl. No.: 214,344

[22] Filed: Mar. 16, 1994

[30] Foreign Application Priority Data

Dec. 14, 1993 [EP] European Pat. Off. ..... 93203515

[51] Int. Cl.[6] ..... B01F 7/18

[52] U.S. Cl. ..... 366/306; 366/304; 366/307; 416/184; 416/199

[58] Field of Search ..... 366/317, 302, 366/303, 304, 306, 307; 416/184, 199

[56] References Cited

U.S. PATENT DOCUMENTS

| | | | |
|---|---|---|---|
| 2,639,901 | 5/1953 | Teale | 366/304 |
| 2,641,453 | 6/1953 | Teale | 366/304 |
| 3,606,577 | 9/1971 | Conn | 416/199 |
| 3,998,433 | 12/1976 | Iwako | 366/304 |
| 4,756,625 | 7/1988 | Schultz | 366/317 |
| 4,813,787 | 3/1989 | Conn | 366/317 |
| 4,915,509 | 4/1990 | Sauer | 366/317 |

*Primary Examiner*—Robert W. Jenkins
*Attorney, Agent, or Firm*—Rosen, Dainow & Jacobs

[57] ABSTRACT

Method for mixing granulates, powders and liquids in a continuous process, whereby the material is placed in a mixing housing and is mixed therein with the aid of a rotor equipped with mixing arms. The material is thereby moved to and fro many times during one rotation of the rotor, towards the rotor axis and away from it. For that purpose the device with which the method is implemented has longitudinal stators, mounted principally in the axial direction of the rotor, between which the mixing arms move when in operation. The mixing housing consists preferably of two chambers situated behind one another seen in the direction of the axis of the rotor and separated from one another by the rotor disk. The material which is to be mixed enters the housing in the first chamber, where it is undergoes a preliminary mix, then flows into the second chamber and is mixed further there.

20 Claims, 2 Drawing Sheets

METHOD FOR MIXING GRANULATES, POWDERS AND LIQUIDS AND A DEVICE THEREFOR

BACKGROUND OF THE INVENTION

The invention relates to a method for mixing two or more materials in granular form, in powder form or liquid, with a viscosity which is or which is not high, in a continuous process in a mixing housing, so that a mixture with a homogenous distribution arises, whereby those materials are introduced into the mixing housing, are mixed therein with the aid of a rudder rotating around an axis, and the mixture is finally expelled from the mixing housing.

Such homogenous mixtures serve, for example, as basic materials for extruding end injection moulding of plastics. The homogeneity of such materials is especially important in cases in which one of the composite materials is a colouring material and a homogenous coloration of the mixture must be achieved.

There are various methods and appertaining devices known in order to achieve the said homogenous mixtures as well as possible. Those methods have in common that those materials are mixed with the aid of a rotating mechanism in a mixing vessel which is filled with the materials concerned, in which they are moved around in the mixing housing in principally a sidle direction. With these methods it is usually not possible to achieve the desired completely homogenous mixture. For example, mixtures of granulates of a plastic and a colouring material will always show the colour in stripes. This is not improved by continuing the mixing process for a longer period of time. On the contrary, in that case a certain separation will even occur in due course as a result of the differences in the densities of the various materials.

SUMMARY OF THE INVENTION

The aim of the invention is to nevertheless achieve the desired homogenous mixing, and to do so in a reasonably short time.

The invention is based on the insight, that if it is possible to make a mixture of materials, with which a mixing housing is filled, move quickly successively in different directions, as a result of which a sort of zig-zag movement is achieved, instead of having it rotate in one direction, the intended results are obtained. The method according to the invention is characterized to that end in that the mixing process takes place by moving the material several times in the mixing housing in relation to the rotational axis of the mixing rotor, alternately towards and from the rotor axis, during one rotation of the mixing rotor, this being defined as one cycle. This prevents the entire contents of the mixing housing as a whole, or at least a large part thereof, from simply rotating along together with the mixing rotor.

It appears, that especially if the change of direction of movement takes place with a frequency of 25 or more per rotation of the mixing rotor, the desired effect is achieved for a large assortment of materials of various grain sizes and viscosities.

As already stated, the advantages of the method become especially obvious if the aim is to mix a colouring material—in the form of granulates, powders or of a very viscous liquid—a paste—with a plastic in powder form or as a granulate.

When mixing certain components, especially if those components are powders, but also when one or more powders must be mixed with one or more granulates, or granulates must be mixed with one another, it is advantageous if the mixing process according to the invention takes place successively in two mixing chambers situated behind one another in the direction of the axis of the rotor, whereby the material is introduced in the first mixing chamber, there undergoes a preliminary mixing, and flows from there to the second mixing chamber where it is mixed further and from which it then flows out of mixing housing.

The mixing process thus is this carried out in two 'steps'. The components are forced to undergo both steps, in chambers which are more or less separated from each other, as a result of which it is not possible that part of the material 'falls' through the mixing housing unmixed or virtually unmixed by the mixing mechanism. As a result of the fact that the inlet opening and the outlet opening are not located in one chamber, the way between the two is blocked for the components.

The invention also includes a device for implementing the method according to the invention in a principally circular-cylindrically shaped mixing housing with the inlet and the outlet opening of the chamber in the cylinder wall and approximately diametrically opposite one another, and with a mixing rotor in the mixing housing, which can rotate around an axis which coincides with the cylinder axis.

Characteristic for that device is that for the material, present in the housing and which is made to move by the rotor, fixed obstacles are present in the housing, that the mixing rotor is equipped with mixing arms which extend principally in the direction of the rotor axis and that those obstacles and the mixing arms are placed in such a manner in respect of one another, that during rotation the material is moved several times during one rotation in a principally radial direction, alternating towards and from the rotor axis.

The material in the mixing housing is moved, as a result of the fact that it 'bumps' against the obstacles, the mixing arms and the walls of the housing, in directions which are more or less at right-angles to the 'route' between the inlet and the outlet opening. A particular flow field for the material arises, whereby it is led alternatively towards the rotor axis and from it; a more or less zig-zag movement.

The mixing rotor is preferably designed as a flat, disk-shaped part, mounted in a detachable manner approximately in the middle of the mixing housing on a rotor axis, which extends through a lid of the mixing housing into the chamber, is fixed therein with beatings, is specially sealed and runs through to approximately half-way in the mixing housing, whereby the disk-shaped part is equipped with one or more rings of mixing arms, which extend on each side of the disk in directions, which are principally perpendicular to the flat disk-shaped part and which have the shape of longitudinal beams, and that the fixed obstacles are one or more rings of beam-shaped parts, which are mounted by their end-surfaces against the insides of the one lid and the other lid, respectively, of the mixing housing, arranged principally symmetrically around the cylinder axis and extending in a direction, which is principally parallel to the cylinder axis, up to a certain distance from the rotor disk—the inner stators—, whereby the radius (radii) of the ring(s) varies (vary) from that (those) of the ring(s) of the mixing arms, while those obstacles may possibly include beam-shaped parts—the so-called outer stators—positioned in their longitudinal direction against the inner wall of the cylinder wall, running principally parallel to the cylinder axis.

It is noted, that especially with a view to the material—and therefore also the weight—saving, both the stators and the mixing arms are preferably designed as hollow profiles.

The inner stators therefore reach from the lids of the housing to just in front of the lower or upper surface, respectively, of the rotor disk; any outer stators which are present run across the entire length of the housing. The mixing arms rotate when in use freely from the obstacles, and between them; the rotor disk therefore turns, seen in a radial direction, between the ring(s) of the inner stators. The outer stators are a kind of thickenings on the inner side of the cylinder wall running in an axial direction, against which they are fixed. It must be avoided that during rotation material gets stuck in the corners between the outer stators and the cylinder wall. To that end the connection between the outer stators and the cylinder wall must be smooth, for example rounded-off, or in a preferred embodiment according to the invention: they must form an obtuse angle, whereby in that case a beam is chosen as an outer stator with a cross-section, perpendicular to the cylinder axis, which is preferably an equilateral, right-angled triangle, of which the slanting side, with which it lies against the cylinder wall, is curved outwards and follows the curve of the cylinder wall.

The mixing arms on the rotor disk are, for example, mounted along the outer edge of the disk, divided regularly across the circumference and possibly further also in a circle situated more inwards on the rotor disk. The mixing arms are preferably beams, with a perpendicular cross-section which is a rectangle or a square, and they are preferably positioned on the disk in such a manner, that one of the diagonals runs in the direction of the radius of the disk; one of the ribs is therefore, seen in a radial direction, turned outwards.

Surprisingly good results are achieved with a device according to the invention, of which the mixing arms which extend on either side of the rotor disk—or at least several of them: those which belong to an inner ring—are located in a manner oblique to the rotor axis, such that the longitudinal symmetrical axes of such mixing arms on the one side of the rotor form an obtuse angle with those on the other side. Often the mixing arms on either side of the rotor disk will belong to one another in pairs: two arms running in each other's extensions. Seen in a radial direction they therefore each form a side of a 'V' in the oblique position referred to here. The material is pressed even more outwards, as it were, by the oblique position of the mixing arms.

A set-up of the mixing arms, whereby their longitudinal axes form an angle of approximately 120°, turns out in practise to produce very good results.

The inner stators are also preferably beams with a rectangular or square perpendicular cross-section, located in such a manner on the front and back lid of the mixing housing that one diagonal of the rectangle or the square is aimed according to the radius of the cylinder.

A well-functioning representative embodiment of the device according to the invention and in which both inner and outer stators are applied has a ring of four inner stators located equally divided across a circle circumference and six mixing arms divided equally across the circumference of the rotor disk on each side of the rotor disk. It also has four outer stators which, seen from the inlet opening of the mixing housing, are positioned along the inner wall of the cylinder wall, at places corresponding with angles of 45°, 135°, 225° and 315° in respect of that inlet opening. The positions of the outer stators in respect of those of the inner stators are always staggered across all angle of 45° in respect of one another.

As has already been explained above in the explanation of the method according to the invention, it is advantageous for mixing certain components if the mixing process takes place in two steps, successively in two 'chambers'. In order to thus carry out the mixing process the mixing device which is to be used to that end is characterized in that the flat, disk-shaped part has a diameter which is only a little smaller than the diameter of the mixing housing, so that it divides the housing into two housings, of which the first contains the inlet opening and the second the outlet opening, and in that the part is equipped with openings through which the material which is to be mixed can flow into the second chamber from the first chamber.

In order to prevent the material from nevertheless 'falling' during the mixing process, unmixed or hardly mixed by the mixing arms and/or the stators, from the inlet opening, through the openings in the rotor disk and through the outlet opening again, the openings in the rotor disk are preferably located around the heart of the rotor disk.

During the rotation the rotor disk therefore rotates within the housing only just free from the housing wall, with only a slight chamber between them, so that it forms a good dividing wall between the spaces. Naturally, the presence of inner stators positioned against the inner wall of the housing is not suitable when the said rotor disk with a large diameter is applied; if the disk rotates 'just' freely within the housing then there will be no space or hardly any space available for those stators.

BRIEF DESCRIPTION OF THE DRAWINGS

The invention is explained further on the basis of the drawing, in which.

DETAILED DESCRIPTION OF THE PREFERRED EMBODIMENTS

Figure 2:
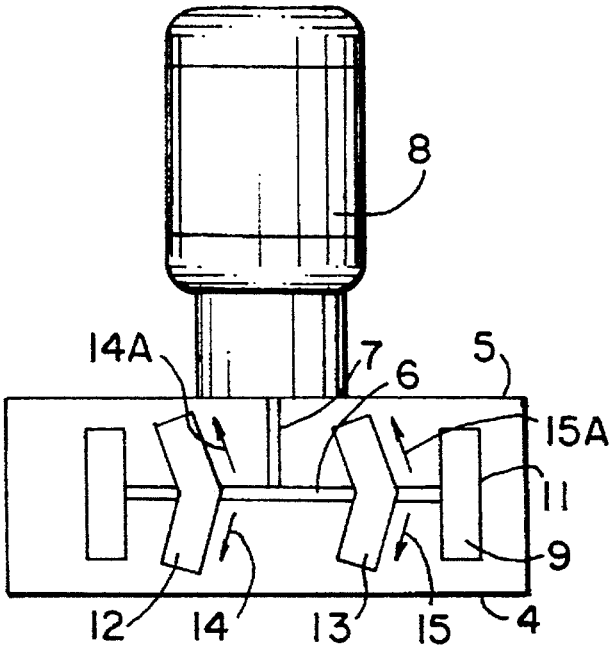
FIG. 2 shows a top view of such a device, opened-up in accordance with a cross-section through the cylinder and rotor axes, perpendicular to the cross-section according to FIG. 1.

The materials which are to be mixed are introduced through the inlet opening 1 into the cylinder-shaped mixing housing 2, which is formed by a cylinder wall 3 and a front and rear lid 4 and 5 (see FIG. 2).

In the mixing housing 2 the rotor disk 6 is located, which is mounted on rotor axis 7, which protrudes through the rear lid 5 and which is driven by the motor 8.

The mixing arms 9, 12, 13 etc. are mounted on this rotor disk 6. These mixing arms 9, 12, 13 are generally hollow beam-shaped parts. On either side of the rotor disk 6 mixing arms extend up to a certain distance of the lids 4 and 5 of the housing 2. In FIG. 2 the mixing arms are applied in either side of the rotor 6 in such a manner, that the two belong to one another: they run in each others' extensions and are formed by one beam which runs through the rotor disk. As explained above this is a special embodiment; they can also be mounted on either side staggered in respect of one another. The mixing arms which are shown have an approximately square cross-section and are positioned on the rotor disk 6 in such a manner, that one diagonal 10 of the cross-section extends approximately in a radial direction. That means that, seen in a radial direction, they have one rib 11 on the outside. In the example drawn in the FIGS. 1 and 2 the diameter of the rotor disk is smaller to some degree than that of the mixing housing 2 and the mixing arms have been positioned along the outer wall of the rotor.

FIG. 2 shows how, in a preferred embodiment, the mixing arms are located slanting on the rotor disk. During rotation of the rotor disk those mixing arms 9, 12 and 13 force the material outwards, as shown with the arrows 14, 14A and 15, 15A. If, however, sticky colouring materials and/or additives are used it is then advantageous to have the rotor turn alternatively left and right in order to prevent the material becoming stuck to the stators and the mixing arms. The mixing arms are then preferably placed perpendicular to the rotor disk in order to avoid 'dead corners'.

In the mixing housing 2 four outer stators 16 and four inner stators 17 are drawn. The outer stators 16 are mounted in the direction of the rotor axis 7 against the cylindrical inner wall 3 of the housing 2. They form obtuse angles 18 with the wall 3 in order to thus avoid the fact that the material gets stuck in a corner during the rotation of the material. They are attached regularly distributed across wall 3 and seen from the inlet opening 1 at places which correspond with arcs of the cylinder circumference of 45°, 135°, 225° and 315°. As a result of the fact that there is sufficient space between the rotor disk and the cylinder wall outer stators can be applied as drawn.

The inner stators 17 (see FIG. 1; not drawn in FIG. 2) are attached to the front and rear lids 4, 5 in rings along circles 19 with a radius, which is smaller than that of the rotor disk 6, so that when the rotor disk 6 with the mixing arms 9, 12, 13 thereon rotates, the mixing arms and the inner stators do not touch each other and operate at the desired distance from one another. Like the mixing arms, the inner stators 17 have a square perpendicular cross-section and are mounted on the lids 4, 5 in such a manner, that one diagonal 20 is directed in a radial direction; those inner stators are therefore also set-up with one longitudinal rib turned outwards.

Furthermore, they are positioned regularly across the circumference of the circle 19 such, that seen from the inlet opening 1, they are located at places corresponding with 90°, 180°, 270° and 370° along the circle. That means that they are located 'between' the outer stators 16.

Figure 1:
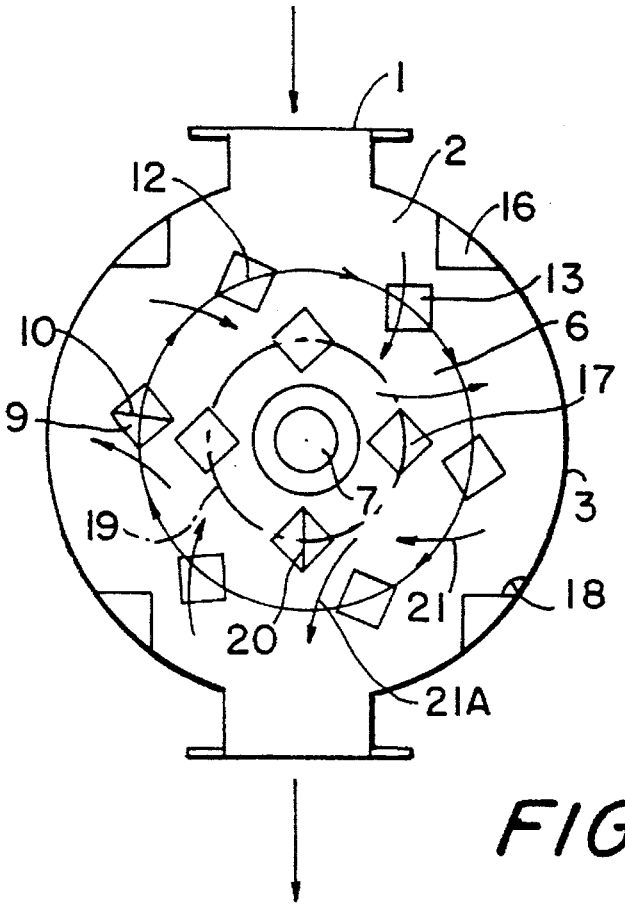
FIG. 1 shows a cross-section of a device according to the invention, through the middle of the mixing housing, perpendicular to the cylinder and rotor axes and with a rotor disk with a diameter which is significantly smaller than that of the mixing housing.

In FIG. 1, arrows 21, 21A etc. show how the material streams run when the rotor is turning. It can be seen clearly that the movement is a zig-zag movement, alternating towards the rotor axis 7 and then away from it.

Figure 4:
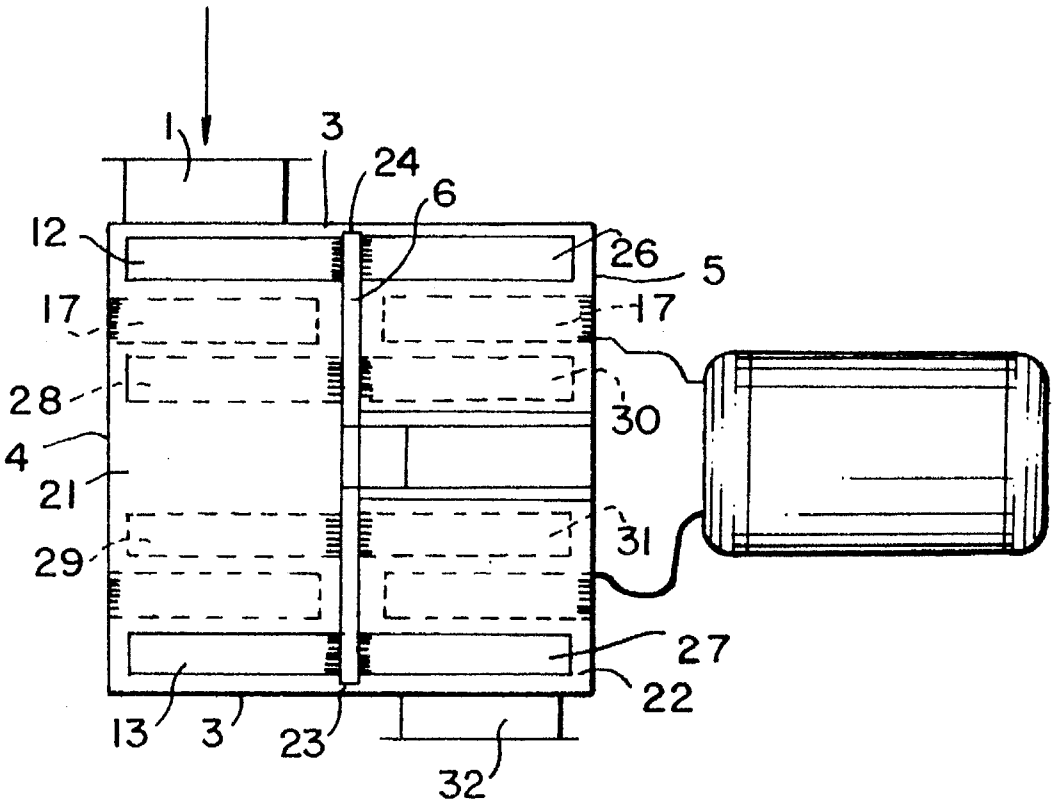
FIG. 4 shows a top view like that in FIG. 2, but now of the device according to FIG. 3.
Figure 3:
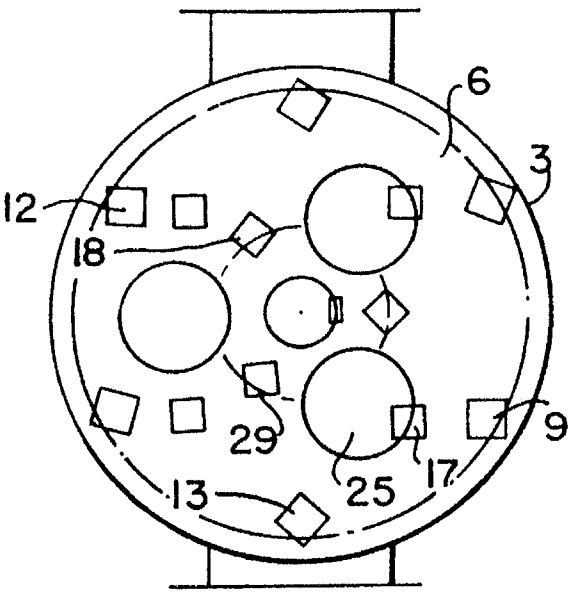
FIG. 3 shows a cross-section like that in FIG. 1, but now with a rotor disk which acts as a dividing wall between two mixing chambers

In the FIGS. 3 and 4 a device according to the invention is drawn which differs from that according to the FIGS. 1 and 2, as a result of the fact that is has two mixing chambers 21 and 22.

The rotor disk 6 has a diameter which is only a little smaller than the inner diameter of the mixing housing. At 23 and 24 it runs just freely during rotation from the housing inner wall 3 and thus forms a dividing wall between the two chambers 21 and 22. In the same manner as shown in the FIGS. 1 and 2 the mixing arms 9, 12, 13 etc. are located on either side of the rotor disk 6 and the inner stators 26, 27 etc. are located on the lids 4 and 5. Besides the 'ring' of mixing arms 9, 12, 13—and on the other side of the rotor disk 6 the corresponding ring of mixing arms 26, 27 etc.—another ring of mixing arms 28 and 29—and on the other side of the rotor disk 6 the corresponding ring of mixing arms 30 and 31—is drawn on the rotor disk drawn in FIG. 3 and FIG. 4. The latter rings are located, seen in a radial direction, within the ring of inner stators 17.

In FIG. 3, 25 shows the openings—three in number—in the rotor disk 6, through which material can flow from chamber 21 to chamber 22 in order to undergo the mixing process there once again.

FIG. 4 shows that, with the use of a device with two chambers and with connecting openings 25 in the rotor disk 6, arranged around the heart of that rotor disk, it is not possible for a component which is introduced into the chamber 21 through the inlet opening 1 to leave the mixing housing again via the outlet opening 32 without participating in the mixing process; there is no longer any 'direct connection' between the two openings.

Example of a Device According to the Invention

Work was done with a mixing device according to the invention with four outer stators, two groups of four inner stators and a rotor disk with a diameter which is significantly smaller than that of the mixing housing and equipped with six mixing arms, which were located at an angle of 30° on the rotor disk. The stators and the mixing arms had square perpendicular cross-sections and were positioned mutually as shown in the FIGS. 1 and 2.

The contents of the mixing housing amounted to 8 liters; the mixing housing had a diameter of approximately 300 mm and a height (thickness) of approximately 120 mm, measured internally.

The diameter of the rotor was approximately 200 mm and the thickness thereof was 5 mm; the length of the mixing arms amounted to approximately 50 mm.

The rotational speed amounted to 90 revolutions per minute. (Due to an undesired large heat development in the mixture this speed will have to be lower for some mixtures.)

The change of direction of movement amounted in this device to: 48 times per rotation.

The materials which were to be mixed were: plastic granulates with a part diameter of 3 to 7 mm, powders and pastes.

With the aid of a mixing process, usual until now, which means, via rotation in a housing, it was not possible to achieve a homogenous mixture. With the aid of the method according to the invention a fully homogenous mixture was acquired. With the mixture which was acquired a good product was even obtained when using out-of-date plastic injection machines and extruders, i.e. those which do not or which hardly mix additionally.

A second example of a device according to the invention is a mixing device in which, as shown in FIGS. 3 and 4, with two rings of mixing arms on either side of the rotor disk: an outer ring with six arms and an inner ring with three arms and with four (inner) stators. When mixing PVC powder with a colouring material, also in powder form, and when mixing granulates of both PVC and colouring material, very homogenous mixtures are acquired.

I claim:

1. A method for mixing at least two, first and second materials in a continuous process in a housing for producing a mixture with a homogeneous distribution of said materials, where at least the first material is in granular or powder form and where said materials are introduced into said housing and mixed therein with the aid of a rotor which rotates about an axis, the mixture subsequently being expelled from said housing, the method comprising the steps of moving said materials in the housing in an approximately radial direction alternately toward and from said rotor axis at least one cycle during each rotation of said rotor.

2. Method according to claim 1 characterized in that the change of direction of movement of the material occurs at least approximately 25 times per rotation of the rotor.

3. Method according to claim 1 characterized in that at least the first of said materials is a plastic or a mixture of plastics, and the second is a colouring material.

4. Method according to claim 1 characterized in that the mixing process in the mixing housing takes place successively in first and second chambers which are located behind one another in the axial direction of the rotor, whereby the material is introduced into the first chamber, undergoes a preliminary mixing therein, and flows from there into the second chamber, where it is mixed further and from which it flows out of the mixing housing again.

5. In an apparatus for mixing at least two materials in a continuous process, the apparatus including a housing having a cylindrical inner wall about a central longitudinal axis and opposite end walls that define a mixing space with inlet and outlet openings in at least one of said walls, a mixing rotor disk rotatably mounting in the housing for rotation about said axis, and means for driving said rotor, the improvement comprising outer stators extending from said inner housing wall toward said rotor, mixing arms extending from said rotor disk generally in said axial direction, said mixing arms situated at a radial distance from said axis less than the radial distance to said outer stators, whereby during rotation of said rotor disk said mixing arm moves said materials in a principally radical direction at least several times during one rotation toward and away from said axis.

6. Device according to claim 5 characterized in that the mixing rotor consists of a flat, disk-shaped part, mounted in a detachable manner approximately in the middle on a rotor axis, which extends through a lid of the mixing housing into the mixing housing, is fixed therein with bearings and runs through to approximately half-way in the mixing housing, whereby the disk-shaped part is equipped with one or more first rings of mixing arms, which extend on each side of the disk in a direction, which is principally perpendicular to the flat, disk-shaped part, and which have the shape of longitudinal beams, and that the fixed obstacles are one or more second rings of beam-shaped parts, which are mounted by their end-surfaces against the insides of the one lid and the other lid, respectively, of the mixing housing, arranged principally symmetrically around the cylinder axis and extending in a direction, which is principally parallel to the cylinder axis, up to a certain distance from the rotor disk—the so-called inner stators—, where by the of each of the second rings differs from the radius of each of the first rings, while beam-shaped parts positioned in their longitudinal direction against the inner wall of the cylinder wall, running principally parallel to the cylinder axis—the so-called outer stators—also belong to those obstacles.

7. Device according to claim 5, wherein said outer stators have such a shape and are attached against the cylinder wall in such a manner, that they make an obtuse angle with the cylinder wall along their entire length.

8. Device according to claim 7, characterized in that the cross section through an outer stator, perpendicular to the cylinder axis, is an equilateral, right-angled triangle, of which the slanting side, with which it lies against the cylinder wall, is curved outwards and follows the curve of the cylinder wall.

9. Device according to claim 8 characterized in that the mixing arms comprise beam whose perpendicular cross sections are rectangles or squares, and that one diagonal of each of them runs in the direction of the radius of the rotor disk at that place.

10. Device according to claim 5 characterized in that at least some of the mixing arms which extend on either side of the rotor disk are located in a manner oblique to the rotor disk, in such a manner that with their longitudinal symmetrical axes perpendicular to the radius of the disk at that place, in such a manner that the longitudinal symmetrical axes of such mixing arms on the one side of the rotor form an obtuse angle with those on the other side.

11. Device according to claim 10, characterized in that the obtuse angle is approximately 120°.

12. An apparatus according to claim 5 further comprising inner stators extending from at least one of said ends axially toward the other end, said inner stators situated at a radial distance from said axis less than the radial distance to said mixing arms, whereby during relation of said rotor disk said mixing arms move said materials in a principally radial direction at least several times during one rotation toward and away from said axis.

13. Device according to claim 12 characterized in that the mixing rotor consists of a flat, disk-shaped part, mounted in a detachable manner approximately in the middle on a rotor axis, which extends through a lid of the mixing housing into the mixing housing is fixed therein with bearings and runs through to approximately half-way in the mixing housing, whereby the disk-shaped part is equipped with one or more first rings of mixing arms, which extend on each side of the disk in a direction, which is principally perpendicular to the flat, disk-shaped part, and which have the shape of longitudinal beams, and that the fixed obstacles are one or more second rings of beam-shaped parts, which are mounted by their end-surfaces against the insides of the one lid and the other lid, respectively, of the mixing housing, arranged principally symmetrically around the cylinder axis and extending in a direction, which is principally parallel to the cylinder axis, up to a certain distance from the rotor disk—the so-called inner stators—, whereby the radius of each of the second rings differs from the radius of each of the first rings, while beam-shaped parts positioned in their longitudinal direction against the inner wall of the cylinder wall, running principally parallel to the cylinder axis—the so-called outer stators—also belong to those obstacles.

14. Device according to claim 5 characterized in that the flat, disk-shaped part has a diameter which is only slightly smaller than the diameter of the mixing housing, so that the horsing is divided into two chambers, of which the first contains the inlet opening and the second the outlet opening, and that the part is equipped with openings through which material can flow into the second chamber from the first chamber during mixing.

15. Device according to claim 14, characterized in that the openings in the flat disk-shaped part are arranged around the heart of that part.

16. In an apparatus for mixing at least two materials in a continuous process, the apparatus including a housing having a cylindrical inner wall about a central longitudinal axis and opposite end walls that define a mixing space with inlet and outlet openings in at least one of said walls, a mixing rotor disk rotatably mounting in the housing for rotation about said axis, and means for driving said rotor, the improvement comprising inner stators extending from at least one of said ends axially toward the other end, mixing arms extending from said rotor disk generally in said axial direction, said mixing arms situated at a radial distance from said axis greater than the radial distance to said inner stators, whereby during rotation of said rotor disk said mixing arm moves said materials in a principally radial direction at least several times during one rotation toward and away from said axis.

17. Device according to claim 16 characterized in that the mixing rotor consists of a flat, disk-shaped part, mounted in a detachable manner approximately in the middle on a rotor axis, which extends through a lid of the mixing housing into the mixing housing, is fixed therein with bearings and runs through to approximately half-way in the mixing housing, whereby the disk-shaped part is equipped with one or more first rings of mixing means, which extend on each side of the disk in a direction, which is principally perpendicular to the flat, disk-shaped part, and which have the shape of longitudinal beams, and that the fixed obstacles are one or more second rings of beam-shaped parts, which are mounted by their end-surfaces against the insides of the one lid and the other lid, respectively, of the mixing housing, arranged principally symmetrically around the cylinder axis and extending in a direction, which is principally parallel to the cylinder axis, up to a certain distance from the rotor disk—the so-called inner stators—, whereby the radius of each of the second rings differs from the radius of each of the first rings, while beam-shaped parts positioned in their longitudinal direction against the inner wall of the cylinder wall, running principally parallel to the cylinder axis—the so-called outer stators—also belong to those obstacles.

18. Device according to claim 16 or 12 characterized in that the perpendicular cross-sections through the inner stators are rectangles or squares and that one diagonal of each of those rectangles or squares runs in the direction of the radius of the cylinder.

19. Device according to claim 16 or 12 characterized in that it contains a ring of four inner stators located equally distributed across a circle circumference on each side of the rotor disk and six mixing arms located equally distributed across the circumference of the rotor disk on each side of the rotor disk, and that it contains four outer stators which, seen from the inlet opening of the mixing housing, are situated along the inner wall of the cylinder wall at places corresponding with angles of 45°, 135°, 225°, and 315° in respect of each other.

20. Device according to claim 19, characterized in that the positions of the outer stators in respect of those of the inner stators are always staggered by an angle of 45° in respect of each other.

* * * * *